US006663444B2

(12) United States Patent
Yeh

(10) Patent No.: US 6,663,444 B2
(45) Date of Patent: Dec. 16, 2003

(54) ELECTRICAL CONNECTOR WITH HIGHLY COMPLIANT TERMINALS

(75) Inventor: Joel J. Yeh, San Gabrie, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 175 days.

(21) Appl. No.: 10/004,946

(22) Filed: Dec. 4, 2001

(65) Prior Publication Data

US 2003/0104714 A1 Jun. 5, 2003

(51) Int. Cl.[7] ..... H01R 4/48
(52) U.S. Cl. ..... 439/862
(58) Field of Search ..... 439/495, 492, 439/108, 608, 610, 607, 609, 66, 862, 700, 941, 676

(56) References Cited

U.S. PATENT DOCUMENTS 5,997,315 A * 12/1999 Akama et al. ..... 439/66
6,315,621 B1 * 11/2001 Natori et al. ..... 439/862
6,398,598 B2 * 6/2002 Masumoto ..... 439/862

* cited by examiner

*Primary Examiner*—Jean F. Duverne
(74) *Attorney, Agent, or Firm*—Wei Te Chung

(57) ABSTRACT

An electrical connector includes a dielectric housing (10) and a plurality of Ω-shaped conductive terminals (30) mounted in the dielectric housing. The dielectric housing defined a plurality of passageways (29) to accommodate the terminals. Each of the Ω-shaped terminals comprises a solder tail (375), a retention portion (37) located in front of the tail portion and secured to the housing, a looped spring portion (31) extending forwardly and upwardly from the retention portion, a horizontal beam (33) extending forwardly from the looped spring portion, an arcuate portion (331) extending forwardly and upwards from a front end of the horizontal beam and a contact portion (333) extending rearwards from a free end of the arcuate portion into a front end portion of a corresponding passageways, said contact portion being adapted for engaging with a terminal of a complementary connector.

14 Claims, 4 Drawing Sheets

ELECTRICAL CONNECTOR WITH HIGHLY COMPLIANT TERMINALS

BACKGROUND OF THE INVENTION

1. Field of the Invention

The present invention relates to conductive terminals in electrical connectors, and particularly to terminals shaped to have improved compliance and thereby reduce stress concentration when the terminals are mated with corresponding terminals of a complementary connector.

2. Related Art

Handheld computers, including personal digital assistants (PDAs) and palm-sized computers, use peripheral or accessory devices to enhance their capabilities and functions. Accessory devices for handheld computers include communication cradles, docking stations, plug assemblies, battery chargers, and modems. Generally, accessory devices are connected with the handheld computers via electrical connector assemblies.

Conventionally, a plug connector is mounted on a handheld computer. An accessory device has a cable connector for mating with the plug connector, thereby achieving electrical connection between the handheld computer and the accessory device. Modern handheld computers are particularly slim, therefore the plug connector can only have a small form factor. Accordingly, conductive terminals of the plug connector are small. This results in high stress concentration in the terminals when the plug connector is mated with the cable connector. High stress concentration accelerates fatigue and increases the risk of breakage of the terminals. Conventional terminals of handheld computer plug connectors do not have good compliance. Therefore the terminals sustain unduly high stress concentration.

Accordingly, improved conductive terminals for plug connectors of handheld computers are desired.

SUMMARY OF THE INVENTION

Therefore, an object of the present invention is to provide an electrical plug connector used in a handheld electronic device, wherein conductive terminals of the plug connector each have a configuration that a normal force generated by the conductive terminals of the connector can be distributed over a long length of the terminals whereby stress concentration of the terminals can be lessened. Therefore, a life of use of the conductive terminals and accordingly the plug connector can be extended.

A further object of the present invention is to provide a plug connector for a handheld electronic device, wherein the conductive terminals of the connector are compliant so that stress concentration of the terminals caused by the normal force of the terminals for effectively engaging with terminals of a complementary connector can be further reduced.

In order to accomplish the above objects, an electrical connector includes a dielectric housing which has a front mating end, a rear mounting end opposite the mating end, two lateral ends between the mating and mounting ends, and a plurality of terminal passageways defined between the mating and mounting ends. A plurality of Ω-shaped conductive terminals are mounted in the passageways on the housing, particularly, each of the terminals comprises a solder tail located about the mounting end of the housing adapted for soldering to a printed circuit board of the handheld electronic device, a retention portion located in front of the tail portion and secured to the housing, a first arced portion extending forwardly and upwardly from the retention portion, a horizontal beam extending forwardly from the first arced portion, a second arced portion extending forwardly and upwards from a front end of the horizontal beam and a contacting portion extending rearwards from a free end of the second arced portion into a front end portion of a corresponding passageways, said contacting portion being adapted for engaging with a terminal of a complementary connector.

In mating with the cable connector, terminals of the cable connector are inserted into upper portions the passageways from the mating end to depress against and engage with the contact portions of the conductive terminals. The terminals generate a normal force by deforming the looped spring portions and the second arcuate portions to effectively and reliable engage with the complementary terminals. As the stress induced by the normal force are distributed over the two arced portions, stress concentration happened in the conventional connector can be improved. Furthermore, since the terminals are secured to the housing only with the retention portions, the terminals can have a good compliance to have a better engaging characteristic with the complementary terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
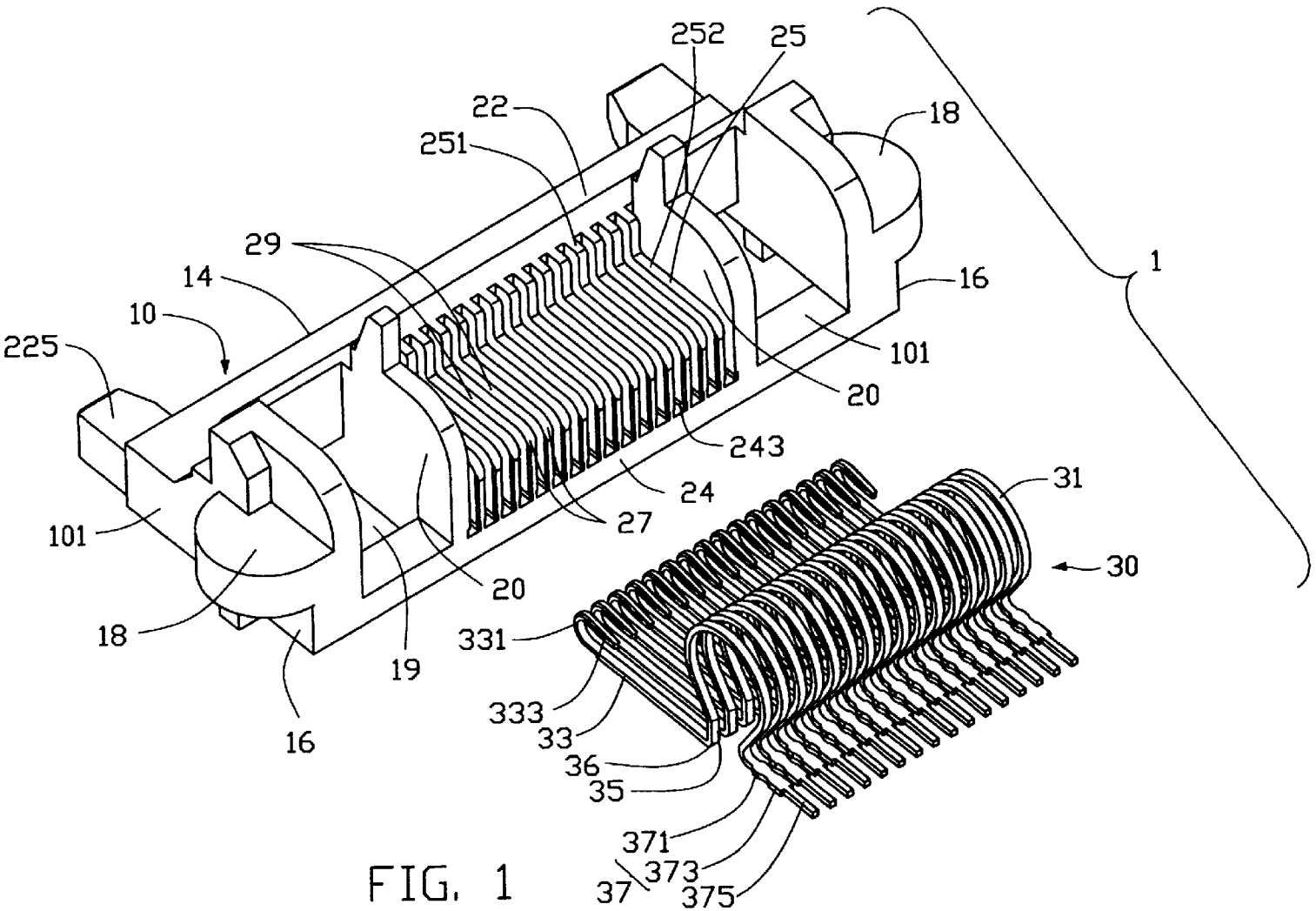
FIG. 1 is an exploded perspective view of an electrical plug connector in accordance with the present invention.

Referring to the drawings in detail, FIG. 1 shows an electrical plug connector 1 in accordance with the present invention. The plug connector 1 is designed for mounting on a printed circuit board (PCB) of a handheld electronic device (not shown) such as a handheld computer or a personal digital assistant (PDA). The plug connector 1 includes an elongated one-piece dielectric housing 10 and a plurality of terminals 30.

The housing 10 is molded from plastic material or other suitable material. The housing 10 comprises a base 101, a front mating end 14, a rear mounting end 24 opposite the mating end 14, and a pair of opposite lateral ends 16 connecting the mating and mounting ends 14, 24. Two locating posts 225 extend forwardly from opposite extremities of the mating end 14, for aligning the plug connector 1 with a complementary cable connector (not shown) prior to mating. A semicircular protrusion 18 is formed at each of the lateral ends 16, for fitting into corresponding recesses defined in a chassis of the handheld electronic device. A shoulder 22 is formed at and parallel to the mating end 14. A terminal accommodating block 25 is formed between the walls 20 and the shoulder 22. The block 25 has a stepped top face 251, thereby defining a recess 252 above a part of the top face 251 that is nearest the mounting end 24. A plurality of parallel terminal passageways 29 is defined in the block 25. Bottom portions of the passageways 29 span between the mounting end 24 and the mating end 14. A plurality of partitions 27 is thus each formed in the block 25, each partition separating two adjacent passageways 29. A pair of slots 243 is defined in bottommost portions of opposite faces of each partition 27, adjacent the mounting end 24. A pair of spaced and parallel walls 20 extends between the mating end 14 and the mounting end 24, on opposite sides of the block 25 respectively. A cavity 19 is defined between one lateral end 16 and its proximate the wall 20.

Figure 2:
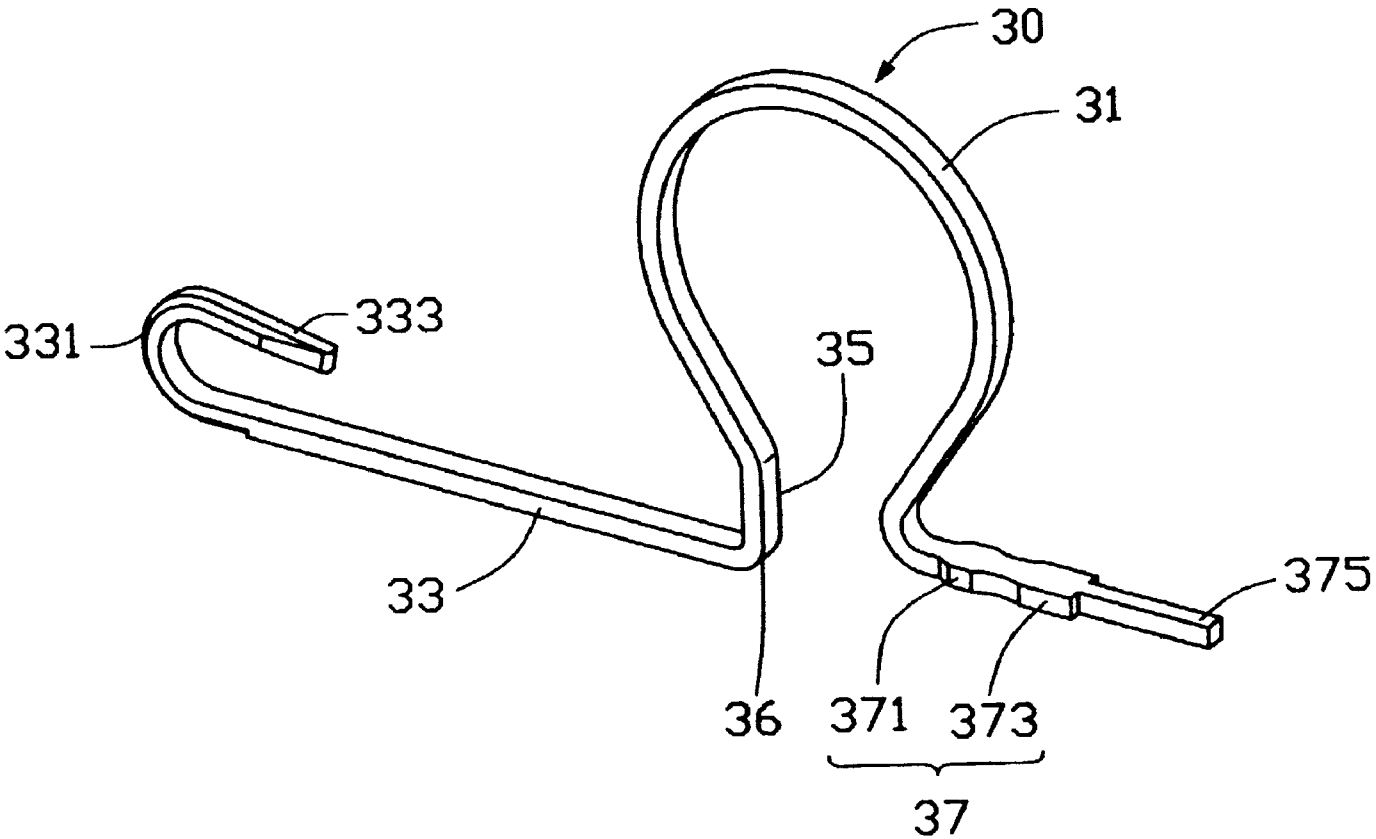
FIG. 2 is a perspective view of a conductive terminal of the connector of FIG. 1.

FIG. 2 shows an omega (Ω) shaped terminal 30, which is stamped and formed from a sheet of conductive material. Each terminal 30 includes a retention portion 37, for being interferentially fixed in two corresponding slots 243 of the block 25. The retention portion 37 comprises a pair of front barbs 371, and a pair of rear barbs 373. A soldering tail 375 extends rearwardly from the retention portion 37, for being soldered to the PCB of the handheld electronic device. A looped spring portion 31 extends upwardly and generally forwardly from the retention portion 37, for protruding into the recess 252 of the block 25. A vertical beam 35 depends from a bottom front extremity of the looped spring portion 31. A horizontal beam 33 extends perpendicularly forwardly from a bottom extremity 36 of the vertical beam 35. A small arcuate portion 331 extends forwardly and then progressively upwardly and then progressively rearwardly from a front extremity of the horizontal beam 33. A contact portion 333 extends rearwardly and slightly downwardly from a free end of the arcuate portion 331.

Figure 3:
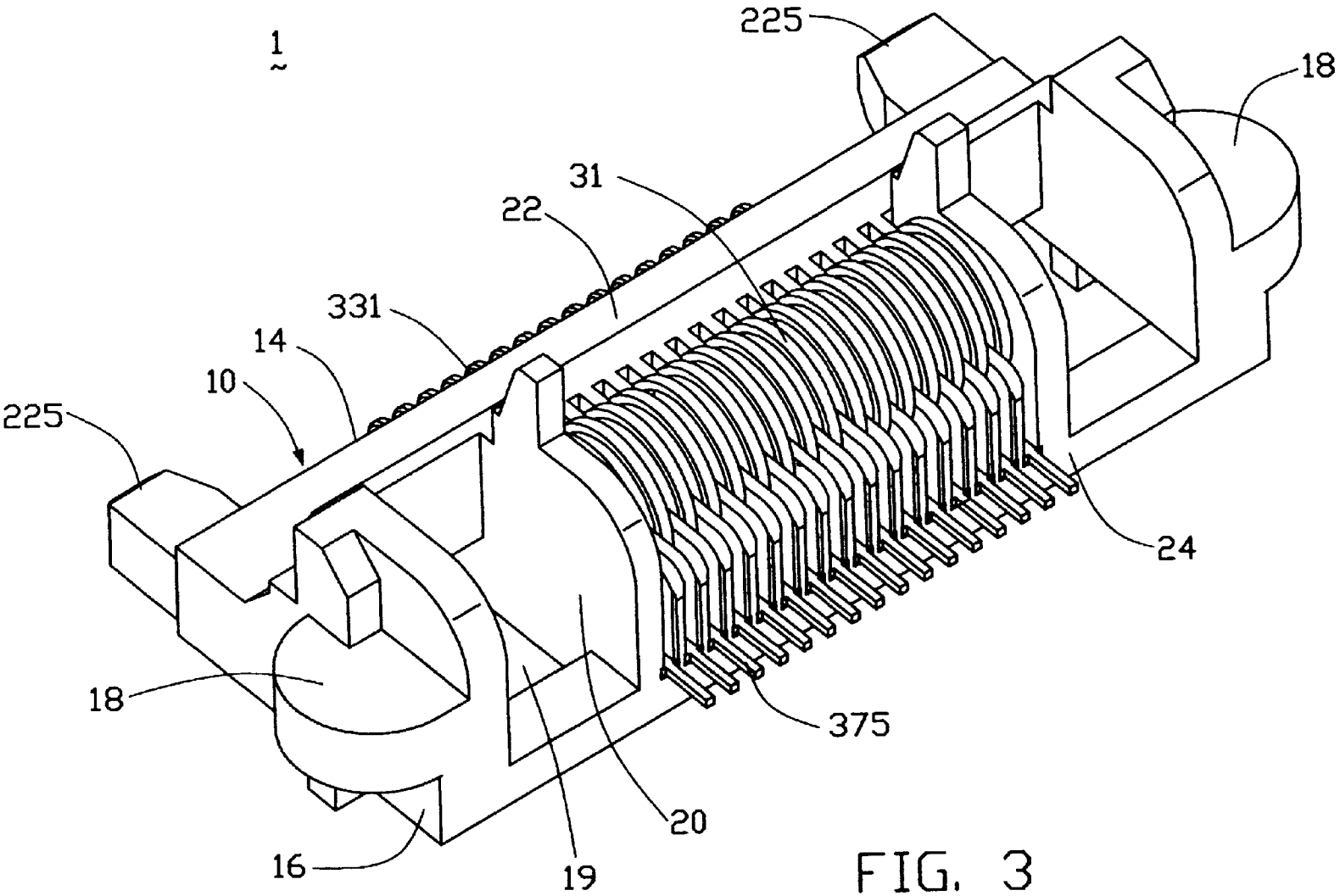
FIG. 3 is an assembled view of FIG. 1.
Figure 5:
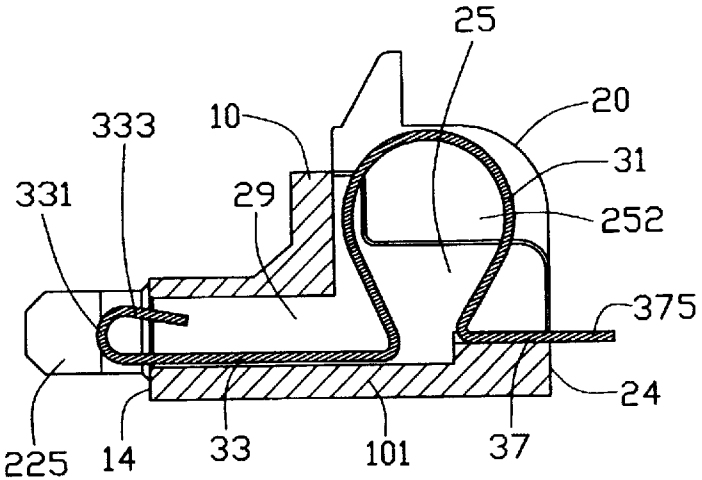
FIG. 5 is an enlarged cross-sectional view taken alone ling V—V of FIG. 4.
Figure 4:
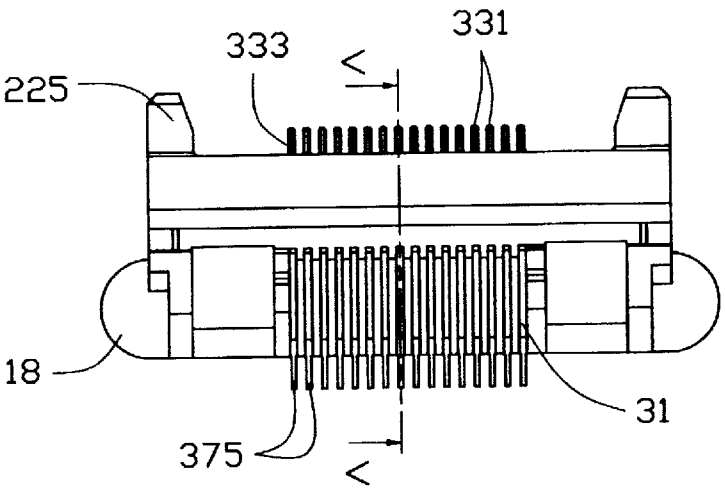
FIG. 4 is a top plan view of FIG. 3.

Referring particularly to FIGS. 3–5, the terminals 30 are mounted into the housing 10. The retention portions 37 are interferentially fixed in the slots 243. The looped spring portions 31 are received in the passageways 29. Upper sections of the looped spring portions 31 project into the recess 252 of the housing 10. The tail portions 375 protrude rearwardly from the mounting end 24, for being soldered to the PCB (not shown) of the handheld electronic device. The horizontal beams 33 are located in the bottom portions of the passageways 29. The small arcuate portions 331 protrude out from the mating end 14 between the locating posts 225. The contact portions 333 extend from the arcurate portions 331 back into the passageways 29. The contact portions 333 are spaced from the housing 10, to facilitate the contact portions 333 contacting with terminals of the cable connector.

When the plug connector 1 is mated with the complementary cable connector (not shown), terminals of the cable connector are inserted into the passageways 29 at the mating end 14 of the plug connector 1. The terminals of the cable connector are inserted above the contact portions 333, and elastically depress and engage with the contact portions 333. The terminals 30 generate a normal force by elastically deforming the looped spring and arcurate portions 31, 331, thereby effectively and reliably engaging with the terminals of the cable connector. Because the stress induced by the normal force is distributed throughout the looped spring and the arcurate portions 31, 331, stress concentration in the terminals 30 is minimized. Furthermore, the terminals 30 are fixed to the housing 10 only at the retention portions 37. Therefore the terminals 30 have excellent compliance, and provide superior engaging characteristics with the terminals of the cable connector.

It will be understood that the present invention may be embodied in other specific forms without departing from its spirit or central characteristics. The present examples and embodiment are therefore to be considered in all respects as illustrative and not restrictive, and the present invention is not to be limited to the details given herein.

What is claimed is:

1. An electrical connector for a handheld electronic device, the electrical connector comprising:

a dielectric housing having a front mating end, a rear mounting end opposite the mating end, two lateral ends between the mating and mounting ends, and a plurality of passageways defined between the mating and mounting ends; and a plurality of Ω-shaped conductive terminals respectively mounted in the passageways, each of the terminals comprising a soldering tail located about the mounting end of the housing and adapted for soldering to a printed circuit board of the handheld electronic device, a retention portion located in front of the tail and secured to the housing, a looped spring portion extending generally forwardly and upwardly from the retention portion, a horizontal beam extending forwardly from the first arced portion, an arcuate portion extending forwardly and then progressively upwardly and then progressively rearwardly from a front end of the horizontal beam, and a contact portion extending rearwardly from a free end of the arcuate portion into a front portion of a corresponding passageway, the contacting portion being adapted for engaging with a terminal of a complementary connector.

2. The electrical connector of claim 1, wherein the looped spring portion of each of the terminals is larger than the arcuate portion thereof.

3. The electrical connector of claim 1, wherein the housing comprises a terminal accommodating block between the mating and mounting ends, the passageways are defined in the block, the block has a stepped top face thereby defining a recess above a rear portion of the block, and the looped spring portions of the terminals each has an upper section projecting into the recess.

4. The electrical connector of claim 3, wherein the block forms a plurality of partitions, each of the partitions separates two adjacent passageways, a pair of slots are defined in bottommost portions of opposite faces of each of the partitions adjacent the mounting end, and the retention portions of the terminals are received in corresponding slots.

5. The electrical connector of claim 4, wherein the tails of the terminals protrude out from the mounting end of the housing.

6. The electrical connector of claim 5, wherein the retention portion of each of the terminals comprises at least a pair of barbs.

7. The electrical connector of claim 1, wherein the contact portions of the terminals are spaced from the housing.

8. The electrical connector of claim 1, wherein each of the terminals comprises a vertical beam between the looped spring portion and the horizontal beam.

9. The electrical connector of claim 1, wherein the housing has two locating posts extending forwardly from the mating end, the locating posts being adapted for aligning the electrical connector with the complementary connector.

10. The electrical connector of claim 1, wherein the housing has two protrusions formed at the lateral ends thereof respectively, for fitting into corresponding recesses of the handheld electronic device.

11. The electrical connector of claim 3, wherein the housing has two side walls located at opposite sides of the block, respectively.

12. An electrical connector comprising:

a dielectric housing defining a plurality of terminal passageways;

a plurality of terminals respectively received in the corresponding terminal passageways, respectively, each of said terminals being formed by bending and generally extending along a front-to-back direction and including:

a downwardly lying C-shaped spring portion;

a horizontal retention portion extending from one end of said C-shaped spring portion;

a soldering tail horizontally extending from said retention portion opposite to said C-shaped spring portion;

a horizontal beam extending from the other end of said C-shaped spring portion; and an arcuate portion formed at a distal end of said horizontal beam opposite to said C-shaped spring portion; wherein said horizontal beam is longer than the combination of the retention portion and the soldering portion.

13. The connector of claim 12, wherein said horizontal beam is higher than the retention portion and the soldering portion.

14. The connector of claim 12, wherein said retention portion includes barbs on two sides thereof to increase dimension along a transverse direction perpendicular to said front-to-back direction.

* * * * *